US005224243A

United States Patent [19]

Schlepfer et al.

[11] Patent Number: 5,224,243

[45] Date of Patent: Jul. 6, 1993

[54] CLEANING LINE WITH FALSE AIR INFEED VALVE FOR REGULATING AIR FLOW THEREIN

[75] Inventors: Walter Schlepfer, Winterthur; Werner Hauschild, Durnten; Jurg Faas, Dinhard; Rene Waeber, Winterthur; Robert Demuth, Nurensdorf, all of Switzerland

[73] Assignee: Maschinenfabrik Rieter AG, Winterthur, Switzerland

[21] Appl. No.: 745,715

[22] Filed: Aug. 16, 1991

[30] Foreign Application Priority Data

Aug. 20, 1990 [DE] Fed. Rep. of Germany ..... 4026330

[51] Int. Cl.[5] ..... D01G 9/08; D01G 9/12; F16K 31/04

[52] U.S. Cl. ..... 19/205; 19/66 CC; 19/65 A; 251/129.04; 406/117

[58] Field of Search ..... 19/55 R, 65 A, 66 R, 19/66 CC, 80 R, 85, 107, 145.5, 200, 202, 205, 296, 105, 204; 209/135, 143, 134, 146; 138/37, 39, 40, 43; 406/183, 187; 137/7, 9; 29/890.145

[56] References Cited

U.S. PATENT DOCUMENTS

| | | | |
|---|---|---|---|
| 1,159,168 | 11/1915 | Broome | 209/135 |
| 1,646,656 | 10/1927 | Munger | 19/205 |
| 1,842,438 | 1/1932 | Wilkinson | 19/205 |
| 2,014,844 | 9/1935 | Holt | 19/107 |
| 2,891,576 | 6/1959 | Kennedy | 251/218 X |
| 2,986,373 | 5/1961 | Masheder | 251/248 |
| 3,280,474 | 10/1966 | Van Doorn et al. | 19/66 CC |
| 3,363,286 | 1/1968 | Scott et al. | 19/66 CC |
| 3,408,115 | 10/1968 | Reiterer | 406/183 X |
| 3,414,329 | 12/1968 | Whitener | 406/183 X |
| 3,435,484 | 4/1969 | Langdon | 19/205 X |
| 3,567,288 | 3/1971 | Wood | 19/65 A X |
| 3,930,285 | 1/1976 | Wornall | 19/65 A X |
| 4,085,977 | 4/1978 | Varga | 406/183 X |
| 4,301,573 | 11/1981 | Gunter et al. | 19/80 R X |
| 4,541,611 | 9/1985 | Tannenläufer et al. | 251/228 |
| 4,723,344 | 2/1988 | Leifeld | 19/80 R X |
| 4,783,048 | 11/1988 | St. Clair | 251/129.04 X |
| 5,021,149 | 6/1991 | Geisseler | 209/143 X |

FOREIGN PATENT DOCUMENTS

| | | | |
|---|---|---|---|
| 0181452 | 5/1986 | European Pat. Off. . | |
| 1152949 | 2/1964 | Fed. Rep. of Germany . | |
| 3127544 | 1/1983 | Fed. Rep. of Germany . | |
| 2573780 | 5/1986 | France . | |
| 2263327 | 11/1987 | Japan | 19/80 R |
| 1601221 | 10/1990 | U.S.S.R. | 19/107 |
| 2010936 | 7/1979 | United Kingdom | 19/107 |
| 2127446 | 4/1984 | United Kingdom | 19/205 |

*Primary Examiner*—Clifford D. Crowder
*Assistant Examiner*—Ismael Izaguirre
*Attorney, Agent, or Firm*—Sandler Greenblum & Bernstein

[57] ABSTRACT

The cleaning or blow room line comprises at least one bale opening machine connected by ducts and at least one cleaning machine and a blender with a plurality of cards. The transport of the fiber flocks extracted by the at least one bale opening machine through the cleaning line is achieved by suction ventilators provided for such cleaning line. After at least one cleaning location a pressure sensor is arranged in an associated duct and delivers a signal to a control or regulator which controls or regulates, as the case may be, the size of a false air opening which co-dictates the air flow through the ducts. The false air opening can be constructed as an adjustable element in the form of a hinged flap or a slide element positioned relative to an opening in a duct, whereby the regulator controls the extent to which the flap or slide member is pivoted or slid, thereby adjusting the amount of air that is drawn into the duct.

21 Claims, 5 Drawing Sheets

CLEANING LINE WITH FALSE AIR INFEED VALVE FOR REGULATING AIR FLOW THEREIN

BACKGROUND OF THE INVENTION

1. Field of the Invention

The present invention relates to a new and improved cleaning or blow room line and to a new and improved method of regulating or controlling such cleaning or blow room line.

Generally speaking, the cleaning or blow room line of the present development is of the type comprising at least one bale opening machine for extracting fiber flocks from bales, such as typically cotton bales. The bale opening machine is connected with a plurality of cards for carding textile fibers of the fiber flocks by means of ducts or conduits and at least one cleaning machine for cleaning the fiber flocks and at least one blender or mixing machine for blending the textile fibers of the fiber flocks. The transport of the fiber flocks removed by the at least one bale opening machine through the cleaning or blow room line is accomplished by suction ventilators or fans provided in the cleaning or blow room line.

2. Description of the Related Art

Such cleaning or blow room lines are exceedingly well known in the art of spinning fibers, thus eliminating the need to more exactly describe the sense and purpose of such cleaning or blow room lines.

As a general rule, such cleaning or blow room machines are equipped with cleaning locations, and the cleaning effect of such machines is partially dependent upon the transport of the material by suction, that is, the cleaning effect of such machines is partially influenced by the suctional conveyance of the material. However, the air or pneumatic conditions for the suctional material transport are not always constant, rather they are unintentionally altered by different external effects, for example, depending upon whether the associated filter installation has just been cleaned or now requires cleaning.

These undesired changes in the pneumatic conditions in the suctional transport of the material also result in non-constant or irregular cleaning. Fluctuations in the effectiveness of the cleaning action are not at all desired, since in certain mills or plants there is presently strived to operate the installation with a constant cleaning action, in order that there can be more easily precluded variations in the properties of the finished product, namely, the yarn.

SUMMARY OF THE INVENTION

Therefore, with the foregoing in mind, it is a primary object of the present invention to provide an improved cleaning or blow room line for textile material and method of regulating or controlling such cleaning or blow room line, in a manner not afflicted with the aforementioned shortcomings and drawbacks.

Another and more specific object of the present invention aims at constructing and controlling a cleaning or blow room line in a manner such that for a predetermined production quantity, namely, throughflow quantity per unit of time, there can be established constant air or pneumatic conditions in the ducts or conduits or the like and the machines themselves, with the result that there can be obtained at least essentially constant technological parameters, especially at the cleaning locations.

Still a further noteworthy object of the present invention is the provision of an improved cleaning or blow room line for textile material and method of regulating or controlling such cleaning or blow room line, so that essentially constant pneumatic conditions prevail for a predetermined production quantity, with the result that there is realized substantially constant cleaning of the textile material at the cleaning machines or the like.

Now in order to implement these and still further objects of the present invention, which will become more readily apparent as the description proceeds, the cleaning or blow room line of the present development is manifested, among other things, by the features that following at least one cleaning machine or cleaning location, as the case may be, a pressure sensor or feeler is arranged in the duct or duct means. The output signal of the pressure sensor or feeler is delivered to a regulator which controls or regulates the size of a false air opening which co-determines or co-dictates the air flow through the duct or duct means.

By inputting a reference or set value for the pressure measured at the location of the pressure sensor, wherein this reference or set value can be selected as a function of the momentarily desired production (kg/hour) and by regulating the size of the opening governing the magnitude of the air flow, it is possible with the employment of relatively simple means or expedients to adjust the actual-pressure value at the neighborhood of the pressure sensor such that it extensively corresponds to the reference or set value. By means of the adjustable or adjustable size false air opening, which is preferably arranged directly upstream or downstream of the pressure sensor, it is additionally possible to adjust the desired constant air o pneumatic conditions at this location without there arising appreciable changes at other locations of the cleaning or blow room line. It should be at least pointed out that when the installation has once been properly adjusted, the regulation action occurring at the adjustable or regulatable false air openings extensively only results in local changes in the pneumatic conditions, however, not in fundamental changes in the pneumatic conditions existing throughout the entire cleaning or blow room line.

Therefore, the undertaken regulation operation is designed for maintaining essentially constant the pressure or volume flow in the relevant duct, that is, at the region of the pressure sensor.

The cleaning machine can be constituted, for example, by a fine cleaning machine. The false air opening is arranged in the duct downstream of the fine cleaning machine, and preferably also downstream of the associated pressure sensor. The same observations are valid when the cleaning machine is constituted by a coarse cleaning machine, and in corresponding manner also then when there is of concern only one cleaning location located at the end of a blender or mixing device or machine.

As contemplated by the present invention, the pneumatic pressure sensor or feeler can be arranged upstream or downstream of the false air opening, depending upon which quantity of air is to be maintained essentially constant.

The false air opening can be, for instance, controlled by an adjustment or setting element in the form of a motor-driven pivotal flap or flap member, which preferably can be outwardly pivoted from a closed position substantially flush with the wall of the associated duct or conduit about a hinge or pivot means provided at the downstream located end of the pivotal flap or flap member. However, the false air opening also can be controlled by an adjustment or setting element constituted by a motor-driven displaceable slide or even by a pivotably arranged butterfly valve or gate or the like. In the case of the butterfly valve, the motor-driven pivotably arranged butterfly valve is preferably disposed in a branch line or conduit opening into the duct. Instead of using a separate regulator operatively interconnecting the pressure sensor and the adjustment or setting element for the false air opening, the function of the regulator can be assumed by a computer controlling or regulating the cleaning or blow room installation and/or the relevant cleaning machine.

In its simplest form, the present invention therefore is a combination of a false air infeed unit having a motor-operated adjustable false air opening which can be installed in a duct or conduit or the like, and a pressure sensor or feeler which likewise can be installed in the duct or conduit or the like, and through the action of a regulator or control the pressure sensor or feeler regulates or controls, as the case may be, the effective size of the adjustable false air opening, in order to maintain a predeterminable pressure or volume flow $\dot{V}$.

Stated in another manner, there is provided the combination of a duct equipped with a false air infeed means possessing an opening, this false air infeed means comprising motor-operated control means for controlling the effective size of the opening through which there is admitted false air, a pressure sensor is installed at the duct for maintaining a predetermined pressure or volume flow condition of the air in the duct, and regulator means are provided which are responsive to the pressure sensor for operating the motor-operated control means in order to regulate the effective size of the opening.

As previously explained, the invention also is concerned with a method of controlling or regulating a cleaning or blow room line of the previously mentioned type, wherein, such method, among other things, is manifested by the features of regulating the effective size of at least one false air opening provided in a duct by a pressure signal obtained from a pressure sensor. The pressure signal is compared with a predeterminable reference or set value signal. A control signal is derived when there exists a difference between the pressure signal and the predetermined reference or set value signal, and such derived control signal is then used in order to maintain constant or predeterminable air pressure or volume flow $\dot{V}$ conditions in the duct.

BRIEF DESCRIPTION OF THE DRAWINGS

The invention will be better understood and objects other than those set forth above, will become apparent when consideration is given to the following detailed description thereof. Such description makes reference to the annexed drawings wherein.

DESCRIPTION OF THE PREFERRED EMBODIMENTS

Describing now the drawings, it is to be understood that only enough of the construction of the cleaning or blow room line defining a product line and its related structure have been depicted therein, in order to simplify the illustration, as needed for those skilled in the art to readily understand the underlying principles and concepts of the present invention.

Figure 1:
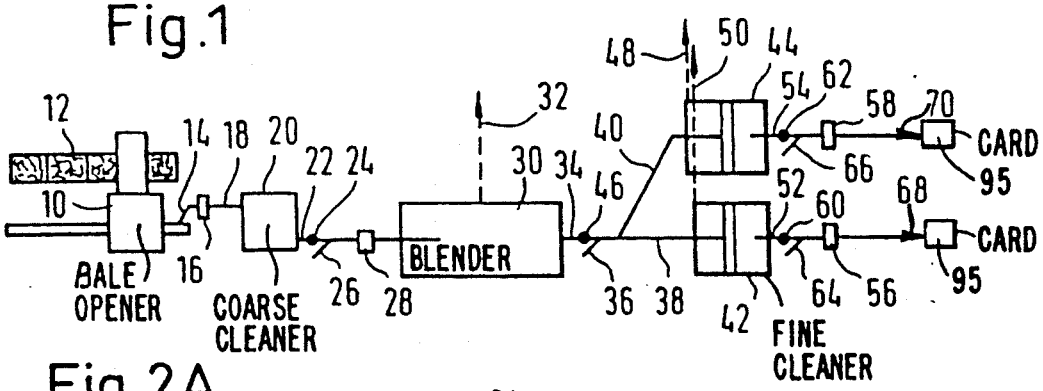
FIG. 1 is a schematic illustration of a cleaning or blow room line defining a product line and constructed according to the present invention.

Turning now to the exemplary embodiment of FIG. 1, the cleaning or blow room line 1 depicted therein and defining a product line, comprises a bale opening machine 10 which extracts fiber flocks or flock material from a row of fiber bales 12, typically cotton bales, and delivers the removed fiber flocks to a duct or conduit 14 or the like. The infeed or intake of the fiber flocks is accomplished by a suction ventilator or fan 16 which subsequently supplies the fiber flocks by means of a duct or duct section 18 to a coarse cleaning machine 20. A pressure measuring sensor or feeler 24, an adjustable or adjustable size false air opening or infeed opening 26 and a suction ventilator or fan 28 are located at a further duct or duct section 22 downstream of the coarse cleaning machine 20. The suction ventilator or fan 28 delivers the stream of fiber flocks into the filling or flock chutes of a multi-chute blender or mixing device 30.

After deposition of the fiber flocks into the filling or flock chutes of the multi-chute blender 30 the transport or conveying air escapes as exhaust or waste air in the direction of the arrow 32. At the outlet or delivery side of the multi-chute blender 30 the blended or admixed fiber flocks are again delivered to a duct or duct section 34 which merges by means of a further adjustable false air opening 36 with two branch lines or conduits 38 and 40. Each such branch line 38 and 40 leads to an associated fine cleaning machine 42 and 44, respectively.

The pressure prevailing in the duct or duct section 34 is measured by a pressure sensor or feeler 46 directly upstream of the false air opening 36. The air responsible for the transport of the fiber flocks emerges from both of the fine cleaning machines 42 and 44, as schematically indicated by the air flow arrows 48 and 50, respectively. The quantities of exhaust or waste air, indicated by the arrows 32, 48 and 50, do not merely exhaust into the atmosphere, rather are conducted by further ducts or duct sections (not shown) to a suitable filter installation where there is filtered out any possibly entrained dust, contaminants and waste.

Following the fine cleaning machines 42 and 44 the finely cleaned fiber flocks are either sucked into a duct or conduit 52 or into a duct or conduit 54, and specifically, by the associated suction ventilators or fans 56 and 58. In each duct 52 and 54 there is provided a respective pressure or pressure measuring sensor or feeler 60 and 62, respectively, and a respective false air opening or infeed opening 64 and 66. Following the suction ventilators 56 and 58 the stream of fiber flocks is delivered, as indicated by the arrows 68 and 70, to the carding room, typically to the feed or filling chutes of the associated cards, simply generally indicated by reference numeral 95 in FIG. 1.

Apart from the depicted suction ventilators 16, 28, 56 and 58 there are provided additional ventilators or fans which are installed at the machines and which also participate in the transport or processing of the fiber flocks. In its totality the cleaning line defining the product line constitutes a rather complex assembly as concerns the pneumatic or air flow aspects. It is also here to be mentioned that the disclosure given herein is only representative of an example of a product line. In actual practice, there can be present many different cleaning or blow room lines defining product lines.

Figure 2A:
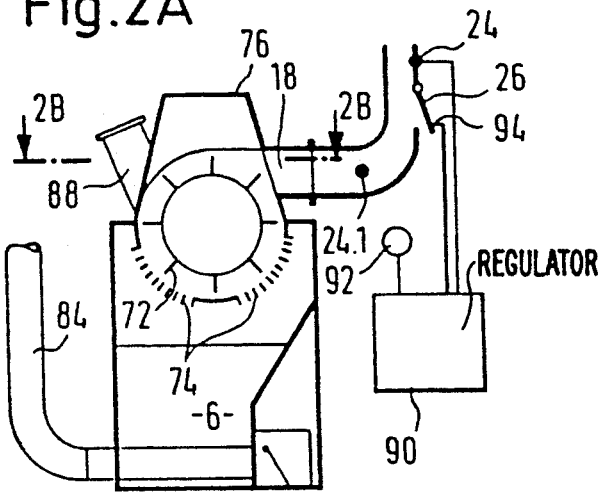
FIG. 2A is a front view of a coarse cleaning machine incorporated into the cleaning or blow room line depicted in FIG. 1.
Figure 2B:
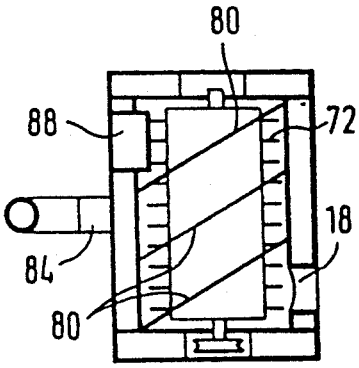
FIG. 2B is a top plan view of the coarse cleaning machine of FIG. 2A.

Initially, attention is invited to FIGS. 2A and 2B for purposes of setting forth a more detailed explanation of the function of the coarse cleaning machine 20.

In the embodiment under consideration, the coarse cleaning machine 20 is constructed as a so-called mono-roll cleaner which is available from the present assignee of this application. The fiber flocks, namely, the cotton flocks delivered by the duct or conduit 18 arrive in a direction which is essentially perpendicular to the lengthwise axis of a rotating pin roll or roller 72 in the coarse cleaning machine 20. Upon impact of the cotton flocks at the rotating pin roll 72 or the like and during the immediately following acceleration in the opposite direction, there is already separated out a decisive proportion of contaminants or the like. Thereafter, the rotating pin roll 72 leads the cotton flocks over a grate or grid 74, accelerates such cotton flocks upwardly into a hood or hood member 76 and again engages such cotton flocks. Since the cotton flocks are turned or tumbled a number of times as they are upwardly propelled or accelerated into the hood 76, all sides of such cotton flocks come into contact with the grate or grid 74. These operations explain the exceedingly effective and protective cleaning function of the mono-roll coarse cleaning machine 20. Moreover, the entire cleaning procedure repeats at least three times, since there are provided three inclined sheet metal guides 80 or the like in the hood 76, which force each of the individual cotton flocks to fly in a substantially helical path about the pin roll or roller 72. A contaminant- and waste collecting chamber or compartment 6 is located beneath the grate or grid 74, and the possibility exists of sucking off the waste or the like which has collected in this contaminant- and waste collecting chamber or compartment 6 at regular time intervals by means of a suction line or conduit 84.

Figure 10:
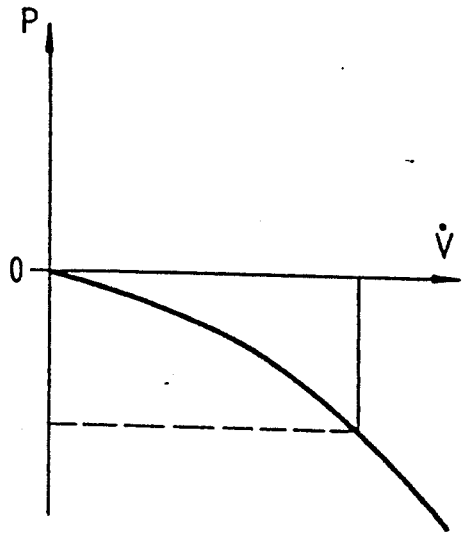
FIG. 10 is a graph illustrating the relationship between the measured static pressure and the volume flow $\dot{V}$ at a pressure measuring location.

The thus cleaned fiber flocks depart from the coarse cleaning machine 20 through the delivery or outlet stud or connection 88 after completing a number of revolutions about the pin roll 72. This delivery or outlet stud or connection 88 merges with the duct or conduit 22 (FIG. 1). The pressure or pressure measuring sensor 22 measures the pressure prevailing in the duct 22 and delivers a pressure signal which is dependent upon the volume flow $\dot{V}$ through such duct 22. FIG. 10 depicts such dependency, and will be seen that increasing negative pressure or vacuum corresponds to an increasing volume flow $\dot{V}$. It will be appreciated that ducts or conduits of spinning mills are usually operated under vacuum conditions in order prevent the formation of fiber fly.

It is here further remarked that the pressure sensor 24 also, however, could be arranged downstream of the false air opening or infeed opening 26, as such has been depicted in FIG. 2A by reference character 24.1. Also depicted in FIG. 2A is the possible arrangement of the pressure sensor 24 or 24.1 at the region of the infeed duct 18.

In the event the measured pressure and thus the volume flow $\dot{V}$ changes, for example, during such time as the waste is sucked out of the waste collecting chamber or compartment 6, then such pressure change is detected and produces, by means of the schematically depicted "regulator" 90 having a reference or set value input 92, an adjustment of an adjusting or setting element 94 which controls the size of the false air opening or infeed opening 26. By virtue of the here realized change in the infeed of false air, it is therefore possible to again adjust the pressure automatically and rapidly to the reference or set value. After completion of the suction operation, there is to be expected an increase in pressure, wherefore the regulator 90 functions in the inverse manner and throttles the infeed of air, so that the volume flow $\dot{V}$ then again assumes the desired reference or set value.

Concerning the regulator 90 such can be constituted by any suitable regulator, for example, a regulator having a PI-behavior behavior or a PID-behavior. However, the regulation operation can be also accomplished by a computer which is available any way for regulating or adjusting the entire cleaning or blow room line. Therefore, in the context of this disclosure the term "regulator" is used in its broader sense to encompass not only a regulator as such, but also a "control" and equally a computer which can achieve the stated regulation or control operations.

Figure 3:
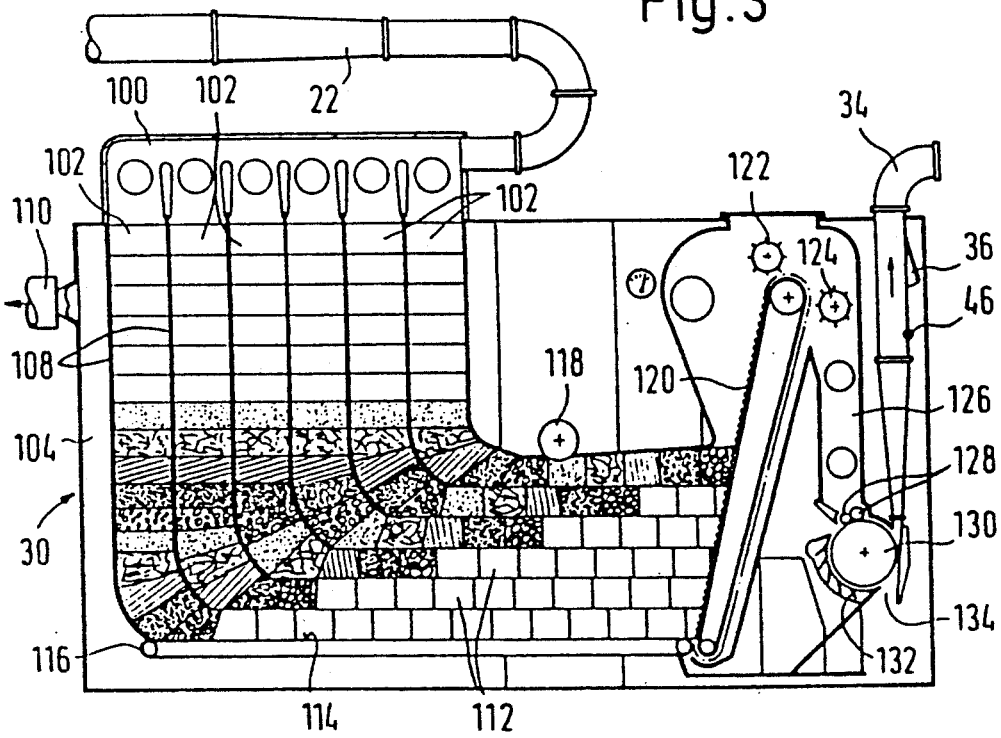
FIG. 3 is a schematic side view of a blender or mixing machine containing a subsequently or downstream arranged cleaning location or site and incorporated into the cleaning or blow room line depicted in FIG. 1.

Variations in the behavior of the air flow also are to be expected at the blender or mixing device or machine 30. To better explain such, reference is now made to FIG. 3. In this FIG. 3, there is shown the manner in which the duct or conduit 22 delivers the flock stream composed of air and fiber flocks into a chamber or compartment 100 which is sub-divided into six chutes 102. These six chutes 102 are separated from one another and from an encircling chamber or compartment 104 by means of the sheet metal sieves 108 having sieve openings or holes. The fiber flocks deposit themselves within the chutes 102 and the air escapes from these chutes 102 into the chamber or compartment 104 and thereafter flows through an exhaust air stud or connection 110 to the aforementioned filter installation.

The fiber flocks located at the lower end of each of the chutes 102 move further in the form of a layered or sandwich structure 112 upon the upper run 114 of a conveyor belt or band 116 or equivalent structure. Due to the different length movement paths of the fiber flocks there occurs a beneficial admixing and homogenization of the fiber flock blend or mixture. The layered or sandwich structure 112, the conveyance of which is augmented by a transport roll or roller 118, is opened by a spiked lattice 120 or the like, likewise constructed as a conveyor belt or band, located at the right side of the conveyor belt 116, and disintegrated into a flock stream carried by the spiked lattice 120. This flock stream is then deposited into a filling chute 126. Reference numerals 122 and 124 designate evener or stripper rolls or the like.

At the lower end of the filling chute 126 there are located two delivery or outlet rolls 128 which deliver the fiber flocks to an opening roll or roller 130 which further opens these fiber flocks and delivers them to an adjustable grate or grid 132 or the like. At this adjustable grate or grid 132 there again occurs a cleaning operation during which contaminants and fiber waste are eliminated. The fiber flock stream or flow is then sucked off through the duct or conduit section 34 by the air flow in such duct and by a false air stream entering via the false air opening or infeed opening 134, and specifically, under the suction action of blowers mounted in the feed heads of both of the fine cleaning machines 42 and 44 (see also FIG. 1).

The pressure sensor 46 detects the pressure existing in the duct or conduit 34 and the thus measured pressure value is applied to a here not shown regulator which regulates the false air opening 36, so that due to the controlled infeed of false air the pressure value can be maintained at a reference or set value which likewise has been inputted to such regulator. Although the regulator has been conveniently omitted from the showing of FIG. 3 to simply the illustration, it will be understood the construction of such regulator can be carried out exactly as described for the regulator 90 used in conjunction with the coarse cleaning machine 20 depicted in FIGS. 2A and 2B.

Now if, for instance, due to increasing clogging of the filter installation which cleans the exhaust air or due to a change in the flow conditions at the neighborhood of the opening roll 130 and the adjustable grate or grid 132, the magnitude of the pressure in the duct or conduit 34 changes, then this pressure magnitude or value is automatically regulated by means of the associated regulator and the false air infeed unit or device is regulated to assume the reference or set value.

Figure 4:
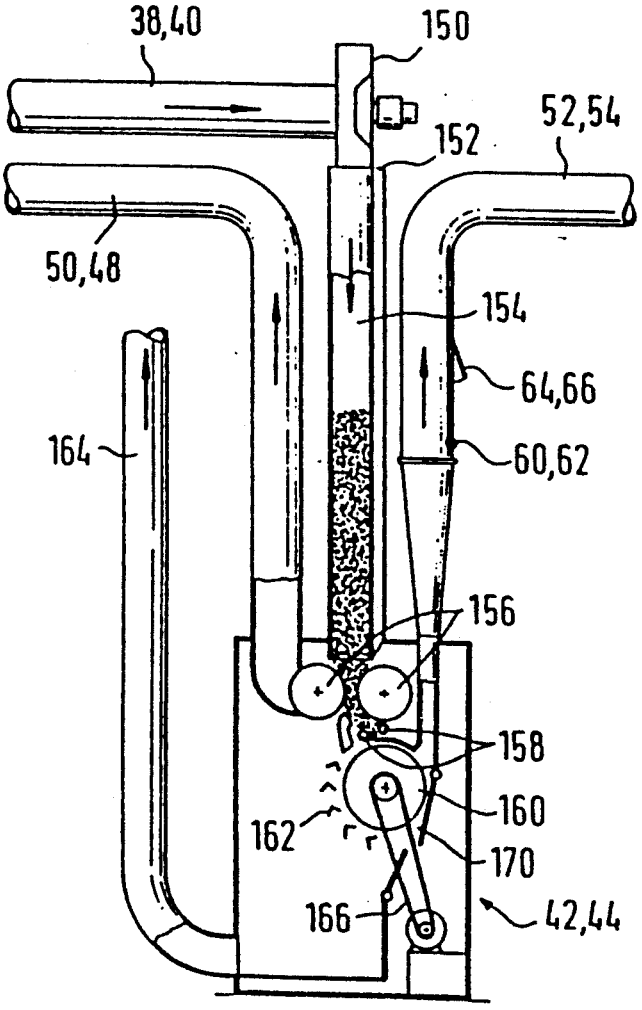
FIG. 4 is a schematic side view of a fine cleaning machine incorporated into the cleaning or blow room line depicted in FIG. 1.

Similar conditions prevail at the fine cleaning machines 42 and 44 which have been schematically depicted in greater detail in FIG. 4. The fiber flock stream or flow is delivered to the respective cleaning machine 42 and 44 by means of the respective ducts or conduits 38 and 40, and specifically, by virtue of the suction action of a suction blower 150 located in the feed head of the corresponding fine cleaning machine 42 and 44. At a location downstream of the suction blower 150 the fiber flocks are delivered to an associated flock or filling chute 154 which approximately corresponds to the flock or filling chute 126 of the blender 30. The air which is transported along with the fiber flocks escapes at the lower end of the associated flock or filling chute 154 and is delivered by the exhaust air ducts or conduits 50 and 48, respectively, to the filter installation. The fiber flocks which have collected in the flock or filling chute 154 are again delivered to an opening roll or roller 160 due to the action of the plain or blind drums or cylinders 156 and the feed rolls 158. This opening roll 160 again opens the fiber flocks and delivers them over a further grate or grid 162 or the like, resulting in the separation of further contaminants and waste fibers which are then conveyed by a waste transport conduit or line 164 to a suitable collecting location. Reference numeral 166 represents the drive for the opening roll 160.

The opened fiber flocks are then suctionally removed by the ducts or conduits 52 and 54, due to the suction action of the suction ventilators 56 and 58, respectively (see FIG. 1). The pressure in the ducts 52 and 54 is measured by the pressure or pressure measuring sensors 60 and 62, respectively, and employed for regulating the position of the associated adjustment or setting element of the false air infeed unit or devices 64 and 66, respectively. Here too, such regulation is accomplished by a regulator, like the regulator 90 previously considered and defined in connection with the coarse cleaning machine 20.

Also with this exemplary embodiment it will be recognized that the pressure conditions can be influenced by the state of cleaning of the filter installation and the position of the grate or grid 162 and the outfeed of the waste by means of the duct or conduit 164 as well as also the leakage air flow entering at location 170. The magnitude of this leakage air flow is dependent, for instance, also upon the relevant production (kg/hour). The regulatable false air infeed units or devices 64 and 66 enable obtaining essentially constant air flow conditions at the cleaning locations.

Figure 11:
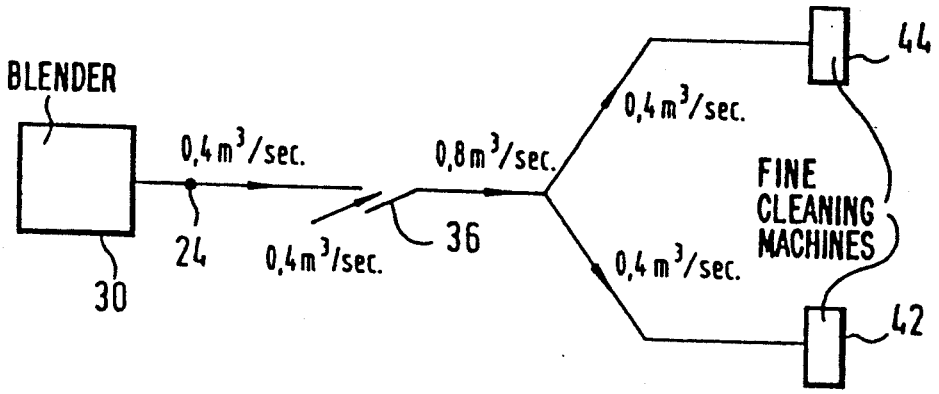
FIG. 11 schematically illustrates the pneumatic conditions prevailing between the blender and both of the fine cleaning machines of the cleaning or blow room line of FIG. 1 defining a product line.

Prior to considering a number of specific embodiments of adjustable false air infeed unit or devices, attention is first directed to FIG. 11. There is schematically depicted in such FIG. 11, based upon a practical embodiment, the air flow conditions prevailing between the blender 30 and both of the fine cleaning machines 42 and 44.

During normal operation, there is contemplated for both fine cleaning machines 42 and 44, at standard temperature and standard pressure, an air throughput or throughflow of 0.4 $m^3$/sec. Normally the same air flow is also provided at the outlet side of the blender 30, that is, likewise 0.4 $m^3$/sec. If both of the fine cleaning machines 42 and 44 are simultaneously in operation, there then prevails a total air flow quantity of 0.8 $m^3$/sec., so that the air flow quantity of 0.41 $m^3$/sec. emerging from the blender 30 is insufficient. It is possible to compensate this insufficiency in the air flow quantity by controlling the false air opening 36 such that there inflows an additional air flow quantity of 0.4 $m^3$/sec., and thus, in conjunction with the air flow quantity of 0.4 $m^3$/sec. emerging from the blender 30 provides the required total air flow quantity of 0.8 $m^3$/sec. However, if one of the two fine cleaning machines 42 and 44 is turned-off, such as the fine cleaning machine 42, for instance, because maintenance must be undertaken at the associated subsequently arranged cards 95 (FIG. 1), then the air flow quantity of 0.4 $m^3$/sec. departing from the blender 30 is totally adequate in order to supply the other operable fine cleaning machine, in this case, then, the fine cleaning machine 44, so that the false air opening 36 can be closed. Opening and closing of this false air opening 36 therefore is accomplished as a function of the pressure measurements performed by the pressure or pressure measuring sensor 46. In any event, both the blender 30 and the two fine cleaning machines 42 and 44 operate with the respective required air flow quantities, so that there is maintained a constant cleaning action.

If there were not provided the false air opening 36, that is to say, if it were not adjustable in its effective size then upon again placing into operation the previously inoperable fine cleaning machine 42 in addition to the other operable fine cleaning machine 44, there would occur an increased air throughflow through the blender 30, resulting in an undesired alteration in the cleaning action of such blender 30. Also, there would have to be expected that the respective air throughflow quantities for both of the fine cleaning machines 42 and 44 would not attain the desired value of 0.4 $m^3$/sec, likewise resulting in these fine cleaning machines 42 and 44 being unable to maintain their desired constant efficiency or performance.

Figure 5:
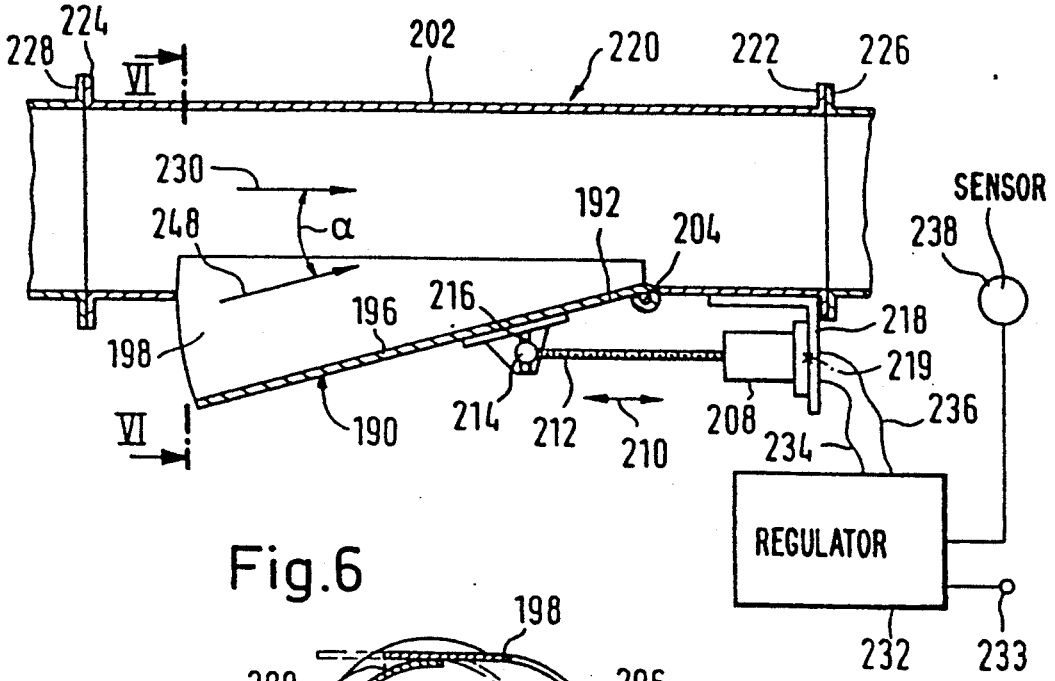
FIG. 5 is a schematic cross-sectional view of a first embodiment of a false air infeed unit or device which can be used in the cleaning or blow room line depicted in FIG. 1.
Figure 6:
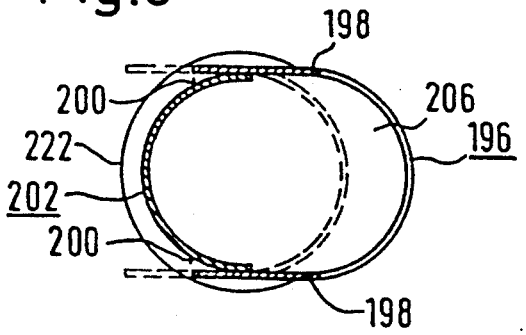
FIG. 6 is a cross-sectional view of the false air infeed unit or device depicted in FIG. 5, taken substantially along the section line VI—VI thereof.

Turning now to FIGS. 5 and 6, there is depicted therein a first exemplary embodiment of false air infeed unit or device, generally indicated in its entirety by reference character 220, the adjusting or setting element 190 of which comprises a closure element in the form of a flap or flap member 196 which is hingedly connected at by the hinge or pivot means 204 at its downstream end 192 at the wall or surface 200 of the associated duct or conduit. As can be particularly recognized in FIG. 6, this flap 196 has an essentially U-shaped cross-section, wherein this U-shape is shown resting on its side, and wherein, both of the legs 198 of the U-shaped flap 196 sealingly slide at the curved circular-shaped surface or wall 200 of the duct 202. By altering the pivot angle $\alpha$ of the flap or flap member 196 about the hinge or pivot means 204 there can be controllably varied the size of the false air opening or infeed opening 206. Pivoting of the flap 196 can be performed by an adjustment or positioning motor 208 or equivalent structure which contains an adjustable or displaceable threaded spindle 212 movable in the direction of the double-headed arrow 210. This threaded spindle 212 is articulated at its left end shown in FIG. 5, at location 214 at the flap 196, by means of a fitting or bracket 216 acting as a lever.

The adjustment or positioning motor 208 is connected by an angle bracket 218 or equivalent connection means with the duct or conduit 202. This adjustment or positioning motor 208 can, for example, drivingly rotate a spherical or ball nut or nut member cooperating with the threaded spindle 212, so that this threaded spindle 212 is reciprocatingly driven for lengthwise movement in the direction of the double-headed arrow 210. Furthermore, this adjustment or positioning motor 208 is rotatably connected at its end facing away from the fitting or bracket 216 with the angle bracket 218 by means of a shaft or axle 219 arranged substantially parallel to the lengthwise axis of the hinge or pivot means 204.

In this exemplary embodiment of false air infeed unit or device 220, which incidentally can be employed, for instance, with the false air openings or infeed openings 26, 36, 64 and 66 previously considered, is constructed as a short duct or conduit section which can be connected by the duct flanges 222 and 224 with and between further duct flanges 226 and 228, respectively of the duct structure. The air or pneumatic flow is carried out in the direction of the arrow 230 shown in FIG. 5. It is here further remarked for the sake of completeness that the angle bracket 218 can be advantageously connected at the duct flange 222 and, if desired, by means of the same threaded bolts or the like which ar used to connected the duct flange 222 with the confronting duct flange 226.

Referring further to FIG. 5, it will be understood that reference character 232 signifies a regulator or computer—hereinafter simply "regulator" as previously defined—which is connected by the lines or leads 234 and 236 with the adjustment or positioning motor 208. This regulator 232 receives a pressure or control signal from the pressure or pressure measuring sensor or feeler 238 which, for example, can define the previously considered pressure or pressure measuring sensors 24, 46, 60 and 62, respectively. Independent of the design of the false air infeed unit or device 220, the pressure sensor 238 can be disposed either downstream or upstream of its adjustment or setting element 190, here defining the flap 196, depending upon which quantity of air should be maintained constant. It is particularly advantageous if this pressure sensor 238 is integrated into the false air infeed unit or device 220, so that such false air infeed unit 220 together with the pressure sensor 238 can be installed as a unit or assembly into the duct 202. Additionally, the regulator 232 contains a reference or set value input 233, as shown in FIG. 5.

Figure 7A:
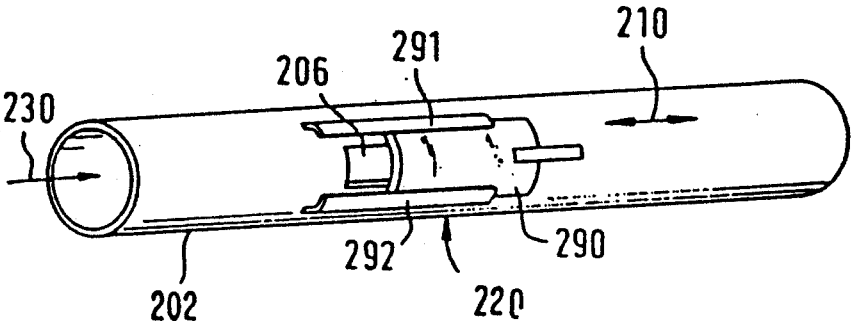
FIG. 7A is a schematic view of an alternative embodiment of a false air infeed unit or device simpler than that depicted in FIG. 7 and which can be used in the cleaning or blow room line depicted in FIG. 1.
Figure 7:
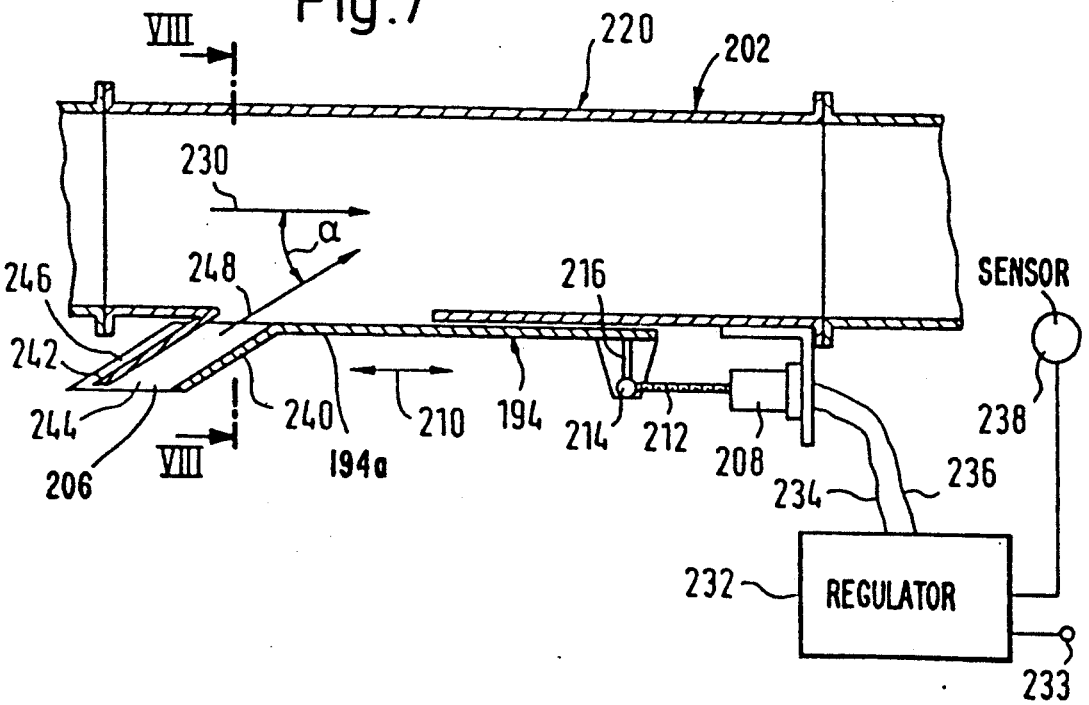
FIG. 7 is a schematic cross-sectional view of a modified second embodiment or construction of false air infeed unit or device in contrast to that depicted in FIG. 5 and which can be used in the cleaning or blow room line depicted in FIG. 1.
Figure 8:
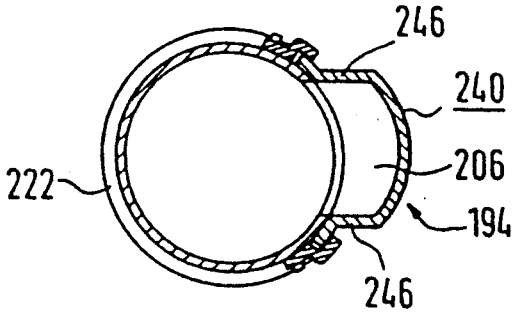
FIG. 8 is a cross-sectional view of the false air infeed unit or device depicted in FIG. 7, taken substantially along the section line VIII—VIII thereof.

FIGS. 7 and 8 depict a modified construction of false air infeed unit or device 220 from that shown in FIGS. 5 and 6, wherein there have been generally used the same reference characters as employed in such FIGS. 5 and 6 to denote the same or analogous structure. A primary difference between both of these embodiments resides in the fact that, in the embodiment of FIGS. 7 and 8 the adjustment or setting element 194 is in the form of a slide or slide element **194*a*, as opposed to the flap 196 of the prior embodiment of FIGS. 5 and 6. Also here, the controlled or adjustable displacement of the slide 194*a* in the direction of the double-headed arrow 210 is accomplished by an adjustment or positioning motor 208 equipped with a displaceable threaded spindle 212 which is connected, for instance, at a hinge or other suitable connection joint 214 with an attachment or bracket 216 secured to the slide 194*a*. At the upstream the slide 194*a*, as viewed with respect to the direction of air flow in the lengthwise direction of the duct 202 as indicated by the arrow 230, there is formed or provided thereat an element 240, for example, formed of sheet metal or plating, which forms in conjunction with, for example, a sheet metal element or part 242 an air infeed channel 244**.

This air infeed channel 244 is bounded at its upper and lower ends by plates or closures 246, in order to define the false air infeed opening 206. In FIG. 7 there is only visible the one lower plate or closure 246. These plates 246 are connected, for instance, with the element or part 240 and can slide past the side edges of the confronting element or part 242. Upon actuation of the rotatable threaded spindle 212 of the adjustment or positioning motor 208 in one direction of rotation, then the element 240 assumes its extreme or terminal left-hand position in FIG. 7 where it abuts against the confronting element or part 242, and thus, obturates the false air opening or infeed opening 206. Conversely, when the threaded spindle 212 is retracted, upon rotation thereof in the opposite direction, the size of the false air opening or infeed opening 206 is progressively enlarged. Since the air infeed channel 244 is inclined with respect to the lengthwise axis of the duct or conduit 202, the air current or flow, schematically represented by the arrow 248 and which enters through the false air opening 206, forms an acute angle o with the duct air flow 230, so that there is extensively precluded the formation of turbulence and the attendant pressure loss and impairment in the efficiency or performance. By way of completeness it is here noted that in the embodiment of FIGS. 5 and 6 there is also maintained small, for the same reasons, the angle $\alpha$ enclosed between the air entering via the false air opening 206 and the air flow 230 occurring in the lengthwise or longitudinal direction of the duct 202.

This observation is also valid for the further embodiment of false air infeed unit or device 220 depicted in FIG. 9, wherein, again, for simplicity in the discussion, there have been generally used the same reference characters as in FIGS. 5, 6, 7 and 8 for the same or analogous elements or parts, so that further consideration of such need not be here undertaken.

Figure 9:
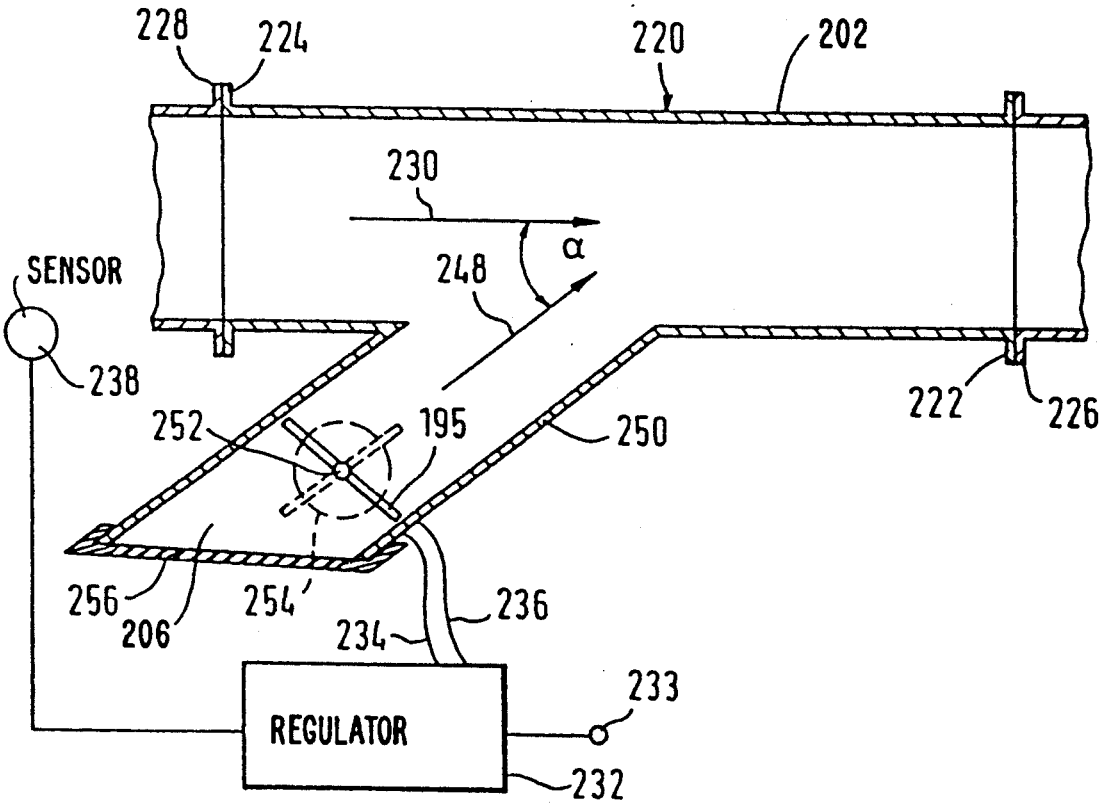
FIG. 9 is a schematic longitudinal sectional view of a modified third embodiment or construction of false air infeed unit or device which can be used in the cleaning or blow room line depicted in FIG. 1.

As to this embodiment of false air infeed unit shown in FIG. 9, the false air opening 206 is here formed by a connection or stud 250 defining a branch line or conduit, the free cross-section of which is controlled by a controllable closure in the form of a so-called butterfly valve or gate 195. This butterfly valve 195 is fastened to a pivot shaft or axle 252 disposed substantially perpendicular to the lengthwise axis of the connection or stud 250. An adjustment or positioning motor 254 governs the rotational position of the butterfly valve 195. In the showing of FIG. 9, this adjustment or positioning motor 254 is shown located beneath the connection o stud 250 and is appropriately attached thereto. The adjustment or positioning motor 254 directly drives the pivot shaft or axle 252, and thus, selectively alters the position of the butterfly valve 195 between the extreme closed valve position shown in full lines in FIG. 9 and the broken line depicted maximum open valve position.

Furthermore, reference character 256 here designates a coarse mesh filter which protects against entry of unwanted contaminants and foreign particles into the connection or stud 250 and into the duct 202. It is to be noted that a corresponding filter 256 can be used with the prior considered embodiments of FIGS. 5 to 8.

In all of the herein considered embodiments, it would be possible to integrate the pressure or pressure measuring sensor or feeler 238 and, if desired, the regulator 232 with the false air infeed unit or device 220, so that there is present only one structural unit or assembly which can be easily handled and is also readily suitable for retrofitting.

Finally, it is remarked that instead of the embodiment of FIG. 7, it would be possible to also provide a simpler embodiment of false air infeed unit or device 220 as depicted in FIG. 7A. To that end, there is provided an arcuate or curved slide or slide member 290 having a curvature matched to the curvature of the associated duct or conduit 202. This arcuate slide 290 is displaceably guided in the guides or guide rails 291 and 292 mounted at the outside or outer wall of the duct or conduit 202. By appropriately controlling and displacing the arcuate slide 290 in the direction of the double-headed arrow 210, in a manner analogous to what was considered with respect to the slide 194*a* of the embodiment of FIG. 7, there is controlled the effective size of the air infeed opening 206. Here too, the air flowing through the duct 202 has been indicated by the arrow 230.

While there are shown and described present preferred embodiments of the invention, it is distinctly to be understood the invention is not limited thereto, but may be otherwise variously embodied and practiced within the scope of the following claims.

What is claimed is:

1. A cleaning line through which move fiber flocks in a predetermined direction of movement, comprising:

at least one bale opening machine for extracting fiber flocks from bales;

a plurality of cards for carding textile fibers to the fiber flocks;

at least one cleaning machine for cleaning the fiber flocks;

a blender for blending the textile fibers of the fiber flocks;

duct means for operatively interconnecting the at least one bale opening machine with the at least one cleaning machine and the blender and the plurality of cards;

said duct means comprising at least one false air infeed means including a false air opening for admitting air into the duct means;

suction ventilator means cooperating with said duct means for transporting the fiber flocks removed by the at least one bale opening machine through the cleaning line;

a pressure sensor provided in the duct means downstream of at least one cleaning location selectively defined by any one of the bale opening machine, the at least one cleaning machine or the blender with respect to the predetermined direction of movement of the fiber flocks;

regulator means operatively connected to the pressure sensor; and said pressure sensor delivering an output signal to the regulator means for controlling the size of the false air opening which co-determine the flow of air through the duct means.

2. The cleaning line according to claim 1, wherein:

said regulator means serve to maintain essentially constant the pressure of the air in the duct means at least at the region of the pressure sensor.

3. The cleaning line according to claim 1, wherein:

said regulator means serve to maintain essentially constant the volume flow of the air through the duct means at least at the region of the pressure sensor.

4. The cleaning line according to claim 1, wherein:

said at least one cleaning machine comprises a fine cleaning machine defining the at least one cleaning location; and said false air opening of the duct means being disposed downstream of the fine cleaning machine and the pressure sensor with respect to the predetermined direction of movement of the fiber flocks.

5. The cleaning line according to claim 1, wherein:

said at least one cleaning machine comprises a coarse cleaning machine defining the at least one cleaning location; and said false air opening of the duct means being disposed downstream of the coarse cleaning machine and the pressure sensor with respect to the predetermined direction of movement of the fiber flocks.

6. The cleaning line according to claim 1, wherein:
said at least one false air infeed means comprise a motor-driven pivotable flap having a downstream end with respect to the predetermined direction of movement of the fiber flocks;
pivot means for pivotably mounting the pivotable flap at said downstream end; and
said pivotable flap controlling an effective size of the false air opening.

7. The cleaning line according to claim 6, wherein:
said duct means comprise duct wall means; and
said pivot means pivotably mounting the pivotable flap at said downstream end for pivotable movement between a closed position substantially flush with said duct wall means for sealing the false air opening and predetermined open positions located outwardly of said duct wall means.

8. The cleaning line according to claim 1, wherein:
said at least one false air infeed means comprise a motor-driven displaceable slide.

9. The cleaning line according to claim 1, further including:
branch conduit means flow communicating with said duct means;
said at least one false air infeed means comprise a butterfly valve provided in said branch conduit means; and
positioning means for operating the butterfly valve.

10. The cleaning line according to claim 1, wherein:
a regulation operation of said regulator means is accomplished by a computer means available for regulating and/or adjusting the entire cleaning line.

11. A cleaning line through which move fiber flocks in a predetermined direction of movement, comprising:
at least one bale opening machine for extracting fiber flocks from bales;
a plurality of cards for carding textile fibers of fiber flocks;
at least one cleaning machine for cleaning the fiber flocks;
a blender for blending the textile fibers of the fiber flocks;
duct means for operatively interconnecting the at least one bale opening machine with the at least one cleaning machine and the blender and the plurality of cards;
said duct means comprising at least one false air infeed means including a false air opening for admitting a flow of air into the duct means;
means cooperating with said duct means for pneumatically transporting the fiber flocks removed by the at least one bale opening machine through the cleaning line;
a pressure sensor provided in the duct means in operative association with at least one cleaning location selectively defined by at least one of the bale opening machine, the at least one cleaning machine or the blender with respect to the predetermined direction of movement of the fiber flocks;
means operatively connected with the pressure sensor; and
said pressure sensor delivering an output signal to the operatively connected means for controlling the size of the false air opening which co-determines the air flow through the duct means.

12. The combination of a duct in a cleaning or blow room line equipped with a false air infeed means having an opening, said false air infeed means comprising motor-operated control means for controlling an effective size of the opening through which there is admitted false air, a pressure sensor installed in the duct for maintaining a predetermined condition in the duct, and regulator means responsive to the pressure sensor for operating the motor-operated control means in order to regulate the effective size of the opening.

13. The combination according to claim 12, wherein:
the pressure sensor maintains as the predetermined condition in the duct the air pressure prevailing in the duct.

14. The combination according to claim 12, wherein:
the pressure sensor maintains as the predetermined condition in the duct the volume flow of the air in the duct.

15. A method of regulating a cleaning line through which move fiber flocks in a predetermined direction of movement, comprising the steps of:
providing a cleaning line containing at least one bale opening machine for extracting fiber flocks from bales, a plurality of cards for carding textile fibers of the fiber flocks, at least one cleaning machine for cleaning the fiber flocks, and a blender for blending the textile fibers of the fiber flocks, wherein duct means operatively interconnect the at least one bale opening machine with the at least one cleaning machine and the blender and the plurality of cards;
transporting the fiber flocks through the cleaning line by suction;
measuring a pressure prevailing in the duct means and obtaining a pressure signal;
comparing the pressure signal with a predetermined set value signal;
deriving a control signal upon deviation of the pressure signal from the predetermined set value signal;
utilizing the derived control signal to regulate the size of a false air opening for admitting air into the duct means, in order to maintain a predetermined condition in the duct means.

16. The method according to claim 15, further including the step of:
utilizing the derived control signal to regulate the size of the false air opening for admitting air into the duct means, in order to maintain as the predetermined condition in the duct means the pressure prevailing in the duct means.

17. The method according to claim 15, further including the step of:
utilizing the derived control signal to regulate the size of the false air opening for admitting air into the duct means, in order to maintain as the predetermined condition in the duct means the volume flow of the air in the duct means.

18. The method according to claim 15, wherein:
the step of measuring the pressure prevailing in the duct means and obtaining a pressure signal is accomplished by using a pressure sensor.

19. The method according to claim 15, wherein:
the step of transporting the fiber flocks through the cleaning line by suction is accomplished by using suction ventilator means.

20. The method according to claim 15, wherein:
the steps of (a) comparing the pressure signal with a predetermined set value signal, (b) deriving a control signal upon deviation of the pressure signal from the predetermined set value signal, and (c) utilizing the derived control signal to regulate the size of a false air opening for admitting air into the duct means, is accomplished by a regulator.

21. The method according to claim 20, wherein:
a computer means is used as the regulator.

* * * * *